US007021827B2

(12) United States Patent
Compton et al.

(10) Patent No.: US 7,021,827 B2
(45) Date of Patent: Apr. 4, 2006

(54) EASY-OPENING FEATURE FOR FLEXIBLE PACKAGES AND PROCESS AND APPARATUS FOR FORMING SAME

(75) Inventors: Stephen F. Compton, Spartanburg, SC (US); Roger J. Morrissette, Hopkinton, NH (US); Mitchell W. Smith, Sr., Newton, NH (US); Frank B. Edwards, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 10/939,646

(22) Filed: Sep. 13, 2004

(65) Prior Publication Data

US 2005/0029146 A1 Feb. 10, 2005

Related U.S. Application Data

(62) Division of application No. 10/285,132, filed on Oct. 31, 2002, now Pat. No. 6,889,483.

(51) Int. Cl.
*B65D 65/26* (2006.01)

(52) U.S. Cl. ..... 383/205; 206/494; 383/66; 383/207

(58) Field of Classification Search ..... 206/459.5, 206/494; 229/87.05, 87, 123.2; 383/200, 383/204, 205, 207, 66, 209; 426/106, 119; 428/41.8, 41.9, 42.2, 42.3, 43
See application file for complete search history.

(56) References Cited

U.S. PATENT DOCUMENTS

| | | | | |
|---|---|---|---|---|
| 1,587,280 A | | 6/1926 | Burke | |
| 1,983,323 A | | 12/1934 | Stokes | |
| 3,273,302 A | | 9/1966 | Walter | |
| 3,438,565 A | * | 4/1969 | Coe et al. | 229/234 |
| 3,442,436 A | | 5/1969 | Kirby, Jr. | |
| 3,641,732 A | | 2/1972 | Fujio | |
| 4,185,754 A | | 1/1980 | Julius | |
| 4,192,420 A | * | 3/1980 | Worrell et al. | 383/207 |
| 4,552,269 A | * | 11/1985 | Chang | 383/66 |
| 4,610,357 A | * | 9/1986 | Nakamura | 206/494 |
| 4,679,693 A | | 7/1987 | Forman | |
| 4,723,301 A | * | 2/1988 | Chang | 383/66 |

(Continued)

FOREIGN PATENT DOCUMENTS

DE 37 00 988 A1 7/1988

(Continued)

OTHER PUBLICATIONS

Openable Label System FH-11-0 Model & Ft-40E, Daily Dishes and Luncheon Series.

(Continued)

*Primary Examiner*—Luan K. Bui
(74) *Attorney, Agent, or Firm*—Alston & Bird LLP

(57) ABSTRACT

An easy-opening feature in a flexible package is provided by forming a tear feature in the package material by slitting, perforating, or otherwise forming a stress riser in the material, and affixing a label to the package material so that the label adheres to the tear feature. The formation of the tear feature and affixing of the label are performed prior to wrapping a product in the package material and sealing the material, and preferably are performed while the package material is moving along a path in a packaging apparatus. The label in one embodiment includes a detachable middle portion that tears free of the rest of the label upon pulling the detachable portion, such that remaining portions of the label remain on the package adjacent the opening created by the tear feature.

6 Claims, 4 Drawing Sheets

U.S. PATENT DOCUMENTS

| | | | |
|---|---|---|---|
| 4,781,294 | A | 11/1988 | Croce |
| 4,834,245 | A | 5/1989 | Ohga et al. |
| 4,840,270 | A | 6/1989 | Caputo et al. |
| 4,859,514 | A | 8/1989 | Friedrich et al. |
| 4,861,414 | A | 8/1989 | Vogan |
| 4,875,587 | A | 10/1989 | Lulham et al. |
| 4,889,731 | A | 12/1989 | Williams, Jr. |
| 4,905,452 | A | 3/1990 | Vogan |
| 4,958,735 | A | 9/1990 | Odabashian |
| 5,060,803 | A | 10/1991 | Beer et al. |
| 5,335,478 | A | 8/1994 | Aronsen |
| 5,409,116 | A | 4/1995 | Aronsen |
| 5,413,412 | A | 5/1995 | Odabashian |
| 5,487,503 | A | 1/1996 | Sato et al. |
| 5,511,664 | A | 4/1996 | Aramaki et al. |
| 5,660,479 | A | 8/1997 | May et al. |
| 5,662,576 | A | 9/1997 | Sprehe et al. |
| 5,806,280 | A | 9/1998 | Su |
| 5,839,648 | A | 11/1998 | Brigand et al. |
| 5,858,167 | A | 1/1999 | Focke et al. |
| 5,908,246 | A | 6/1999 | Arimura et al. |
| 6,026,953 | A | 2/2000 | Nakamura et al. |
| 6,203,867 | B1 | 3/2001 | Derkach et al. |

FOREIGN PATENT DOCUMENTS

| | | | |
|---|---|---|---|
| EP | 368 240 | A1 | 5/1990 |
| EP | 0 511 171 | A1 | 10/1992 |
| EP | 0 665 173 | A1 | 8/1995 |
| EP | 0 745 539 | B1 | 12/1996 |
| EP | 0 752 375 | B1 | 1/1997 |
| EP | 0 911 259 | A1 | 4/1999 |
| GB | 2 373 234 | A | 9/2002 |
| JP | 10167321 | A | 6/1998 |
| JP | 11342975 | A | 12/1999 |
| WO | WO 00/17060 | | 3/2000 |
| WO | WO 00/58079 | | 10/2000 |

OTHER PUBLICATIONS

Partial International Search Report for Application No. PCT/US03/33773, Filed Oct. 28, 2003; Date Mailed Mar. 18, 2004.

International Search report for Application No. PCT/US03/33773; Filed Oct. 28, 2003; Date of Completion Jun. 3, 2004; Date of Mailing Jun. 22, 2004.

* cited by examiner

EASY-OPENING FEATURE FOR FLEXIBLE PACKAGES AND PROCESS AND APPARATUS FOR FORMING SAME

CROSS-REFERENCE TO RELATED APPLICATION

This application is a divisional of U.S. patent application Ser. No. 10/285,132 filed on Oct. 31, 2002, U.S. Pat No. 6,889,483, the entire disclosure of which is incorporated herein by reference.

FIELD OF THE INVENTION

The invention generally relates to flexible packaging having features to facilitate tearing through the packaging to open a package. The invention more particularly relates to a process and apparatus for packaging products in flexible web material and forming easy-opening features in the web material, and to easy-opening features for such packages.

BACKGROUND OF THE INVENTION

Food and other products are often packaged for retails purposes in flexible film. Such packages often include some type of feature to help the consumer in opening the package. Most easy-opening features include a cut or perforation formed through the film, and a tear tape, pull tab, header card, or the like affixed to the film in the vicinity of the cut or perforation. One known type of easy-opening feature, for example, includes a V-shaped notch formed in the film, and a pressure-sensitive tear tape adhered to the film over the V-shaped notch. The notch is cut into the film after the film has been wrapped about a product, and then the tear tape is applied to the film over the notch. Pulling the tear tape is supposed to initiate tearing of the film to create an opening therein.

When piercing through the film on a finished package containing the product, fragile products may be cut, damaged, or contaminated. The likelihood of this occurring is particularly great when the product does not have a consistent and predictable shape and/or orientation within the package. Thus, such methods are generally not suitable for irregularly shaped products.

When using an applied component such as a header card, adhesive label, tear tape, or the like, it is sometimes difficult to register the applied component with the cuts or perforations in the film. If the applied component is incorrectly registered, the opening mechanism may not work properly.

Some applied components can easily become inadvertently detached from the package during shipping and handling, for example by being snagged when the package is handled. This can compromise the package integrity and may also compromise integrity or freshness of the product. Even if the package and product integrity are not compromised, the easy-opening feature will no longer work as intended, and the consumer may have to resort to secondary means such as scissors or a knife to open the package.

Many existing easy-opening features are limited in versatility in that a tearing is initiated in only one direction. If that tearing should fail for any reason, the consumer often is not left with any other convenient means of opening the package and again may have to resort to using scissors or a knife. As an example of such a failure, the above-noted V-shaped notch is intended to initiate a tear about equal in width to that of the notch, and the desire is for that tear to continue along the full length of the package. However, frequently what happens is that the edges of the tear soon converge, resulting in only a small sliver of film being removed along with the tear tape, pull tab, or label, thus producing only a small opening in the film. It can be difficult to find that opening after the label is removed.

SUMMARY OF THE INVENTION

The present invention addresses the above needs and achieves other advantages. In accordance with one aspect of the invention, a process for packaging products comprises the steps of advancing first and second continuous web portions of film along a path, piercing or otherwise forming a tear feature in the advancing web to act as a stress riser in the web, and affixing a label to one surface of the advancing web such that the label is affixed to the tear feature of the web and to a region of the web surrounding the tear feature. The process further includes steps of enclosing a product between the portions of the advancing web, and sealing respective edges of the web portions together to form a package of the film enclosing the product. If the film is a heat-shrinkable film, the process includes the further step of heating the package to shrink the heat-shrinkable film about the product. In accordance with this aspect of the invention, the steps of forming the tear feature in the web and affixing the label are performed prior to the step of enclosing the product. Thus, there is no chance of accidentally cutting or damaging the product when piercing the web to form the tear feature, and the process can be applied to irregularly shaped products.

In one embodiment of the invention suitable for making non-hermetic packages, the label is affixed to the web prior to piercing to form the tear feature. Both the label and the web then are simultaneously pierced to define at least one tab portion of the label and the corresponding tear feature of the web. If desired, the piercing can be carried out such that two or more tab portions and corresponding tear features are created. For example, the web and label can be pierced along two lines that intersect in a generally X-shaped configuration to define four tab portions and tear features each of generally triangular outline. Accordingly, the web can be torn along more than one direction, making opening of the package easier. Furthermore, if for any reason one tab portion should fail to operate satisfactorily, another tab portion can be operated.

In an easy-opening feature having the tab portions as noted above, and particularly adapted for shrink-wrap packages, advantageously the label is affixed to an exterior surface of the web and includes a heat-shrinkable film layer joined to a non-heat-shrinkable layer. The step of heating the package to shrink the web causes the tab portions of the label and the corresponding tear features of the web to curl outward so as to be more-easily graspable. Alternatively, the label can be non-heat-shrinkable and can be affixed to an interior surface of the web (i.e., on the product side). In this case, shrinking of the web still tends to cause the tab portions and corresponding tear features to curl outwardly for easy grasping.

In some embodiments of the invention, a sensor is used to detect the label on the advancing web and a signal from the sensor is used to coordinate movement of the tool relative to the advancing web such that the tool pierces the label. The label can include a layer of paper or other optically detectable material such that the label is readily detectable with an optical sensor or the like.

The invention is also applicable to production of hermetic packages, such as for food products. In one embodiment of the invention, the label includes a moisture and oxygen barrier layer and is affixed to the web so as to hermetically cover openings formed through the web when piercing the web to form the tear feature. Advantageously, the label is provided to include a tab portion that remains unaffixed to the web after the affixing step, the tab portion facilitating grasping the label to open the package.

Advantageously, the web can be pierced to include a plurality of perforation lines that have inner ends that are proximate but spaced from one another, the perforation lines generally diverging and extending to opposite outer ends thereof. The label is sized and positioned such that the outer ends of the perforation lines are spaced from an outer periphery of the portion of the label that adheres to the web. Various patterns of perforation lines can be used.

The label can be provided to include a portion that separates from the remainder of the label when pulled to tear through the web to open the package, whereby one or more portions of the label remain on the web to form additional grasp and tear points. For instance, an easy-opening feature in accordance with one embodiment employs a label that includes a central area that is not affixed to the web and areas on opposite sides thereof that are affixed to the web. Tear features are formed in two spaced regions and the affixed areas of the label are respectively located to adhere to the tear features. The central non-affixed area of the label is perforated or scored to form two tab portions. One tab portion can be pulled in one direction to initiate tearing in that direction, and the other tab portion can be pulled in another direction to tear the web in that direction. Another embodiment employs a label having a central portion designed to tear free from two side portions of the label that flank the central portion. The central portion is in registration with and affixed to a tear feature of the web formed by making a perforation or otherwise forming a stress riser in the web. The easy-opening feature is operated by pulling the central portion of the label so as to pull the tear feature and tear the web to form at least a small opening in the web. The side portions of the label remain affixed to the web at the opening, and can be grasped and pulled to further tear the web.

In some embodiments of the invention, the advancing web is arranged in a C-fold configuration having two portions of the web in overlying opposing relation. The label is affixed to an inner surface of one of the web portions that faces the other web portion. The label can be affixed to the one web portion by a label applicator that intrudes between the opposing web portions and advances the label in a direction transverse to the web's advancement. Advantageously, the label is circular so that orientation of the label relative to the web does not matter. The piercing step is performed prior to enclosing a product between the web portions. The web portions can be inverted (i.e., folded in the opposite direction from their initial folded configuration) prior to enclosing the product, such that the label applied to the one web portion ends up being on the exterior of the package.

The invention also encompasses an apparatus for packaging products, comprising a web supply system for advancing first and second continuous web portions of film along a path, a tool operable to form a line of weakness in the advancing first web portion such that the line of weakness creates a tear feature that acts as a stress riser so that pulling the tear feature initiates tearing of the first web portion at the tear feature, a label applicator operable to affix a label to one surface of the advancing first web portion such that the label is affixed to the tear feature of the first web portion, and a product wrap and seal arrangement located downstream of the tool and the label applicator for enclosing a product between the first and second web portions and sealing respective edges of the web portions together to form a package of the film enclosing the product.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 7:
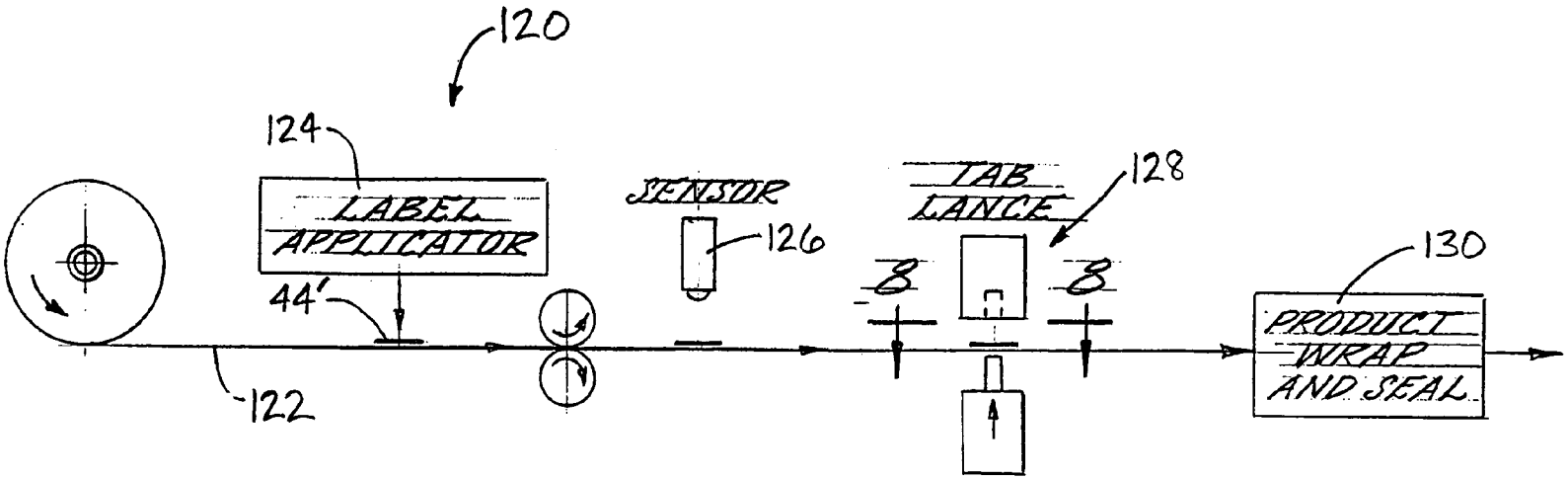
Figure 9:
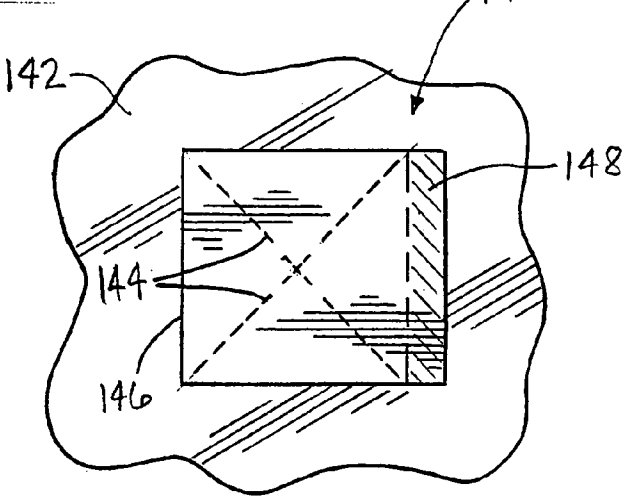
Figure 8:
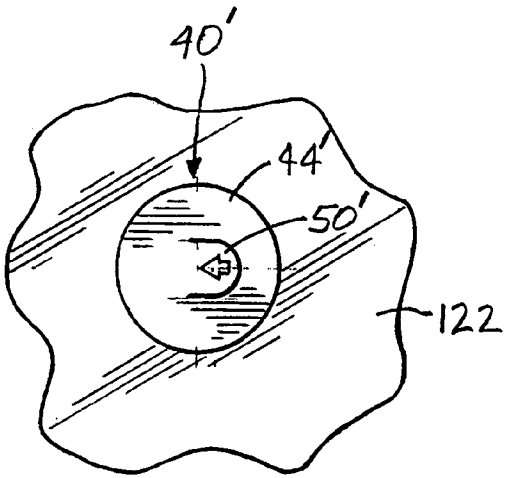
Figure 10:
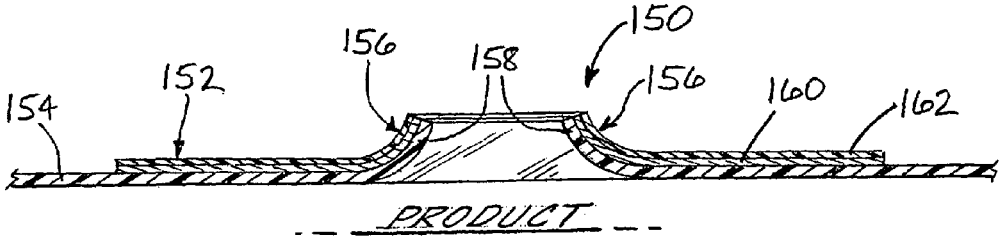
Figure 11:
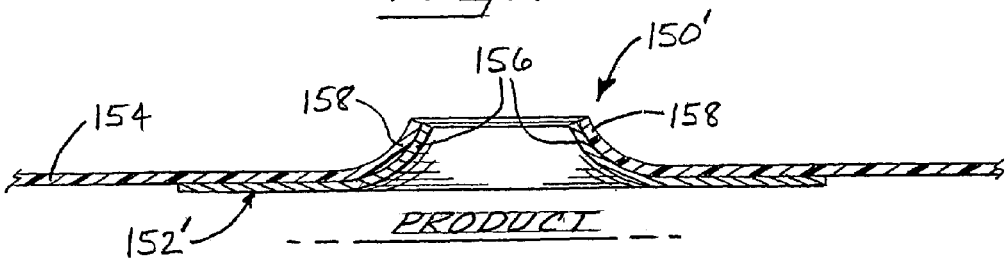
Figure 12:
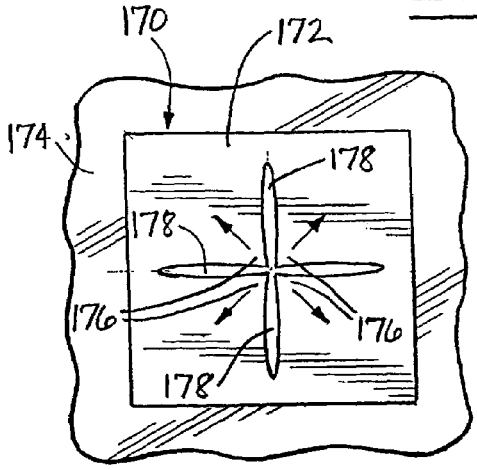
Figure 13:
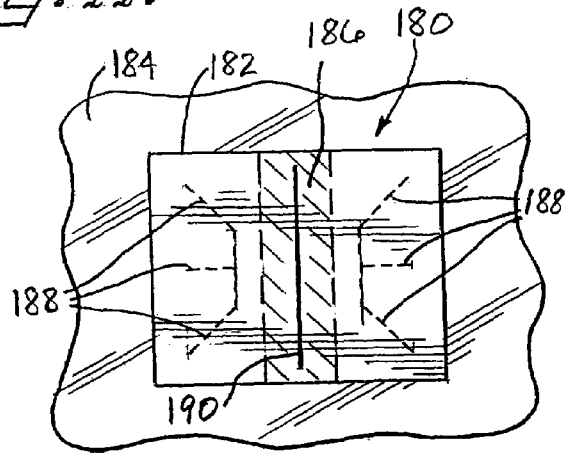

FIG. 7 schematically illustrates an alternative apparatus and process in accordance with the invention;

FIG. 8 is a view along line 8—8 in FIG. 7 showing an alternative easy-opening feature in accordance with the invention;

FIG. 9 shows yet another alternative easy-opening feature in accordance with the invention;

FIG. 10 depicts a label incorporating a heat-shrinkable film layer in accordance with another embodiment of the invention, with the label affixed to the exterior of the package;

FIG. 11 shows a non-heat-shrinkable label affixed to an interior surface of a heat-shrink package in accordance with another embodiment of the invention;

FIG. 12 shows yet another alternative easy-opening feature in accordance with the invention; and FIG. 13 depicts a still further easy-opening feature in accordance with the invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
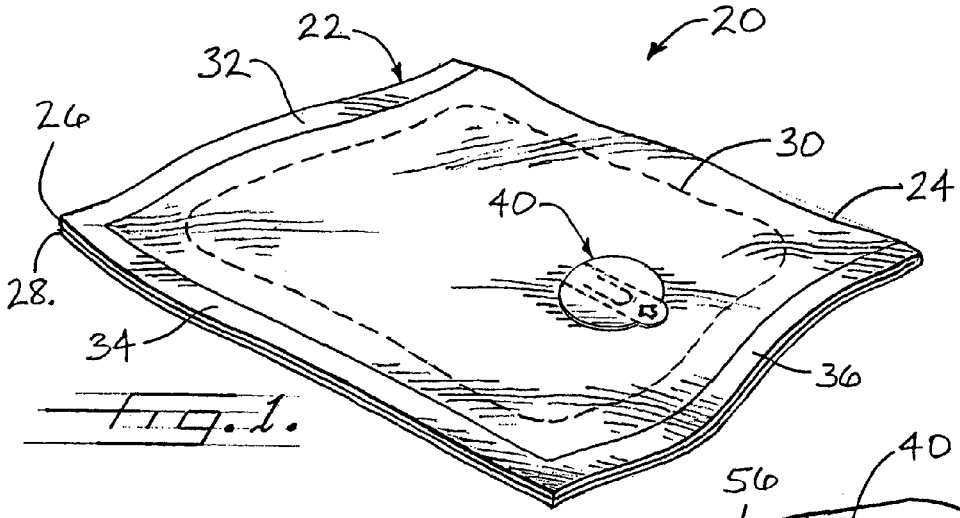
FIG. 1 is a perspective view of a package having an easy-opening feature formed in accordance with one embodiment of the invention.

FIG. 1 shows a package 20 in accordance with one embodiment of the invention. This particular package is formed of a film web 22 that is centerfolded along a fold line 24 to form two opposing web portions 26 and 28 between which a product 30 is disposed. The edges of the web portions 26, 28 are sealed together along seals 32, 34, and 36 to enclose the product. An easy-opening feature 40 is incorporated in the web portion 26.

Figure 2:
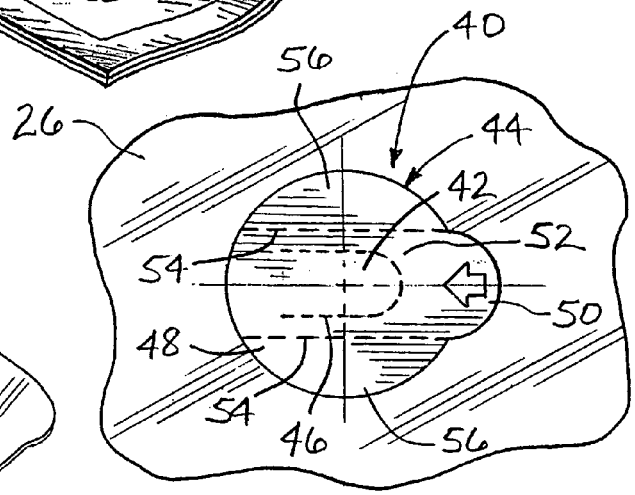
FIG. 2 is a top view of the easy-opening feature in FIG. 1.

The easy-opening feature 40 is shown in greater detail in FIG. 2. The easy-opening feature 40 comprises a tear feature 42 formed in the web 26, and a label 44 affixed to the web covering the tear feature 42. The tear feature 42 in the web is formed by lancing, perforating, scoring, etching, or otherwise forming a line of weakness 46 in the web so as to define a portion of the web that will readily separate from the remainder of the web and act as a stress riser at which tearing of the web will initiate when the tear feature is pulled in an out-of-plane direction. In the illustrated embodiment, the line of weakness 46 is U-shaped, but other shapes can be used instead.

Figure 4:
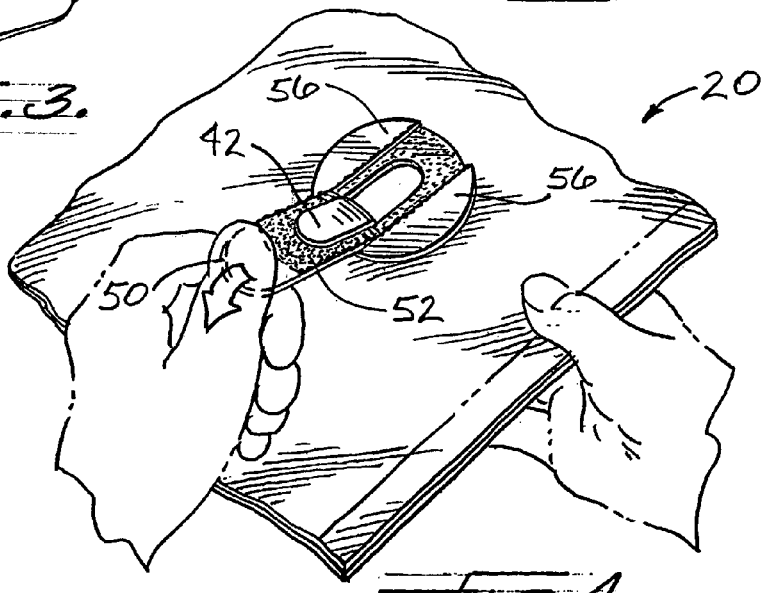
FIG. 4 depicts the easy-opening feature of FIGS. 1–3 being operated to tear open a package.

The label 44 includes a circular portion 48 that is affixed to the tear feature 42 and to a region of the packaging web 26 surrounding the tear feature. The circular portion 48 of the label can be affixed to the web by adhesive, heat-sealing, or any other suitable method. The label also includes a tab portion 50 that remains unaffixed to the web 26 so that it can readily be grasped and pulled. As an example, the circular portion 48 may be backed by a pressure-sensitive adhesive, and the tab portion 50 may be free of adhesive. The tab portion 50 is connected to a middle detachable portion 52 of the label. The detachable portion 52 is delineated by two spaced parallel lines 54 of perforations or the like that extend the full width of the portion 48. The detachable portion 52 is located in registration with and is affixed to the tear feature 42 in the web 26. To initiate tearing of the web 26, the tab portion 50 of the label is grasped and pulled out-of-plane and generally in the direction of the perforation lines 54. As the detachable portion 52 of the label is pulled it detaches from the remainder of the label and pulls the tear feature 42, which causes a region of the web 26 to be torn out of the web for some distance along the web, thus creating an opening in the web as shown in FIG. 4.

Even if the edges of the torn-out part of the web soon converge, it is easy to locate the opening that has been created in the web because two portions 56 of the label remain affixed to the web 26 adjacent the opening. The label preferably is constructed to be readily visible; for example, the label can include a paper or other opaque layer that visibly contrasts with the film web 26. Accordingly, the remaining label portions 56 can easily be located. Either or both of the label portions 56 can be grasped and pulled generally away from each other to further tear and enlarge the opening in the web.

The package 20 and easy-opening feature 40 are applicable to hermetic as well as non-hermetic packages. In the case of a hermetic package, the portion 48 of the label affixed to the web covers any openings formed through the web in creating the tear feature 42. The label 44 preferably includes a gas and moisture barrier layer such as a polyester (e.g., PET) film layer, which can be laminated to a paper layer. The barrier layer can be a metallized film. Alternatively, a metallized paper layer can be used as the barrier layer.

Figures 5, 6:
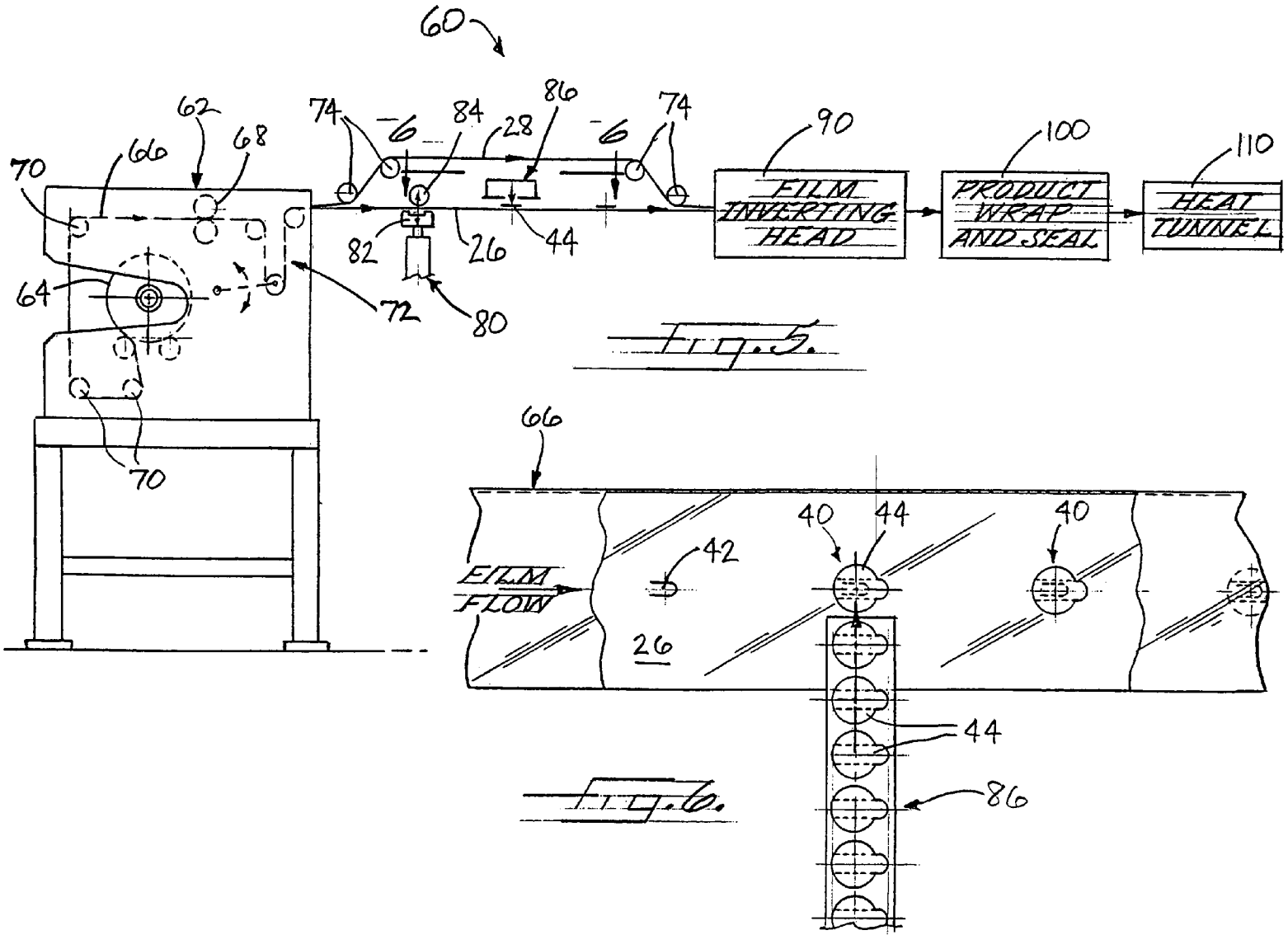
FIG. 5 is a schematic depiction of an apparatus and process for packaging a product in accordance with one embodiment of the invention.
FIG. 6 is a view taken along line 6—6 in FIG. 5.

FIG. 5 shows a process and apparatus 60 for forming flexible easy-open packages in accordance with one embodiment of the invention. The apparatus 60 includes a web supply system 62 that mounts a roll 64 of centerfolded ("C-fold") web material 66 and advances and guides the web 66 along a path, such as by pinch drive rolls 68 and guide rolls 70 or the like. The web supply system can include an accumulator/tension control unit 72 if desired. The web supply system also includes web guides 74 for opening up the C-fold web 66 so that the two web portions 26, 28 are still generally parallel to each other but are spaced apart for some distance along the path of travel of the web.

Figure 3:
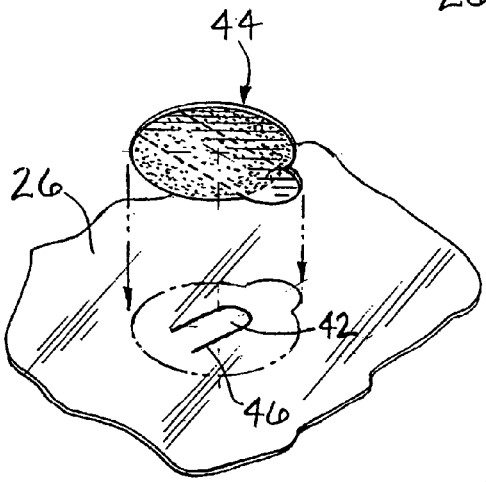
FIG. 3 is a perspective view showing a label being applied to a packaging web to form an easy-opening feature as shown in FIG. 1.

In the region where the two web portions 26, 28 are separated, a web-piercing tool 80 is arranged for forming a slit, perforation, score line, or other line of weakness in the web portion 26. In the illustrated embodiment, the tool 80 comprises a punch and die arrangement having a die 82 arranged on one side of the web portion 26 and a punch 84 arranged on the opposite side of the web portion 26. The die 82 preferably defines a sharp cutting edge in a generally U-shaped configuration. The punch and die are movable toward each other to sandwich the web portion 26 therebetween and cause the web portion to be cut by the sharp cutting edge of the die. Advantageously, the tool 80 can comprise a Shanklin high-speed hole punch available from Shanklin Corporation of Ayer, Mass., or a BSP-3000 ball swivel punch available from Park Air Corporation of Brockton, Mass., modified to cut only a U-shaped slit rather than a full circle; such hole punches employ a ball as the punch and the die has a die cavity defining a circular sharp edge of smaller diameter than the ball. A portion of the circular edge can be dulled so that it does not cut. The tool 80 thus forms the tear feature 42 in the web portion 26 as shown in FIG. 3. The tool 80 can be used with an intermittent process in which the web is intermittently advanced and then brought to a halt for the punching operation; advantageously, however, the process is continuous such that the web does not have to be stopped for the punching operation. The ball-and-die type punches previously mentioned are particularly suited to such continuous processes.

Downstream of the tool 80, a label applicator 86 is arranged for applying a label to the surface of the web portion 26 that faces the other web portion 28. The label applicator 86 is shown in greater detail in FIG. 6. The applicator 86 advances labels 44 in a transverse direction relative to the direction along which the web 66 is moving and then blows a label with a blast of air onto the web portion 26. The applicator 86 can comprise a model CTM 360 label applicator available from CTM Integration, Inc. of Salem, Ohio, or the like. The operation of the applicator 86 is synchronized with the advancement of the web 66 and the operation of the punch tool 80 so that the label is applied to the web portion 26 in registration with the tear feature 42 so as to form the easy-opening feature 40. As will be understood by those of skill in the art, the easy-opening features 40 are formed at regular intervals along the web portion 26 corresponding to the product pitch of the packaging apparatus.

The packaging apparatus 60 can also include a film inverting head 90 downstream of the label applicator for turning the C-folded web through about a 90° change of direction and folding the web inside-out so that the label 44 is then on an exterior side of the web portion 26 (i.e., the side that faces away from the other web portion 28). Such inverting heads are well-known and hence will not be described in greater detail. After the inverting head, the apparatus includes a product wrap and seal arrangement 100 operable to deposit a product between the two web portions 26, 28 and then seal the web portions together (typically by heat-sealing) along their edges and along transverse seal lines and sever the resulting package from the web. If the web material 66 is heat-shrinkable, the apparatus can optionally include a heat tunnel 110 for heating the package to shrink the web material about the product. The apparatus discharges a package 20 as shown in FIG. 1.

The process and apparatus shown in FIG. 5, and the package shown in FIGS. 1–4, are suitable for hermetic applications where it is desired to hermetically seal the product in the package. The slit or opening formed through the web portion 26 by the tool 80 is covered by the label 44.

As previously noted, the label can incorporate suitable barrier material so that the opening is hermetically closed by the label.

The invention is also applicable to non-hermetic applications. FIG. 7 shows a process and apparatus 120 suitable for such applications. The apparatus 120 unwinds web material 122 from a roll and advances the web along a path. In this case, the web 122 is a flat (unfolded) web. A label applicator 124 affixes labels 44' to the web at product pitch intervals. Downstream of the label applicator 124, a sensor 126 detects each label 44' as it passes by, and creates a signal indicating the label has been detected. Downstream of the sensor 126, a punch and die arrangement 128 or the like is arranged for piercing the label 44' and the web 122 along a generally U-shaped line to form a tab portion 50' (FIG. 8) in the label and a corresponding tear portion (not visible in FIG. 8) in the web. The tab portion of the label is adhered to the tear portion in the web. The apparatus 120 also includes a product wrap and seal arrangement 130 for wrapping products and sealing the web to form packages. As will be understood by those skilled in the art, the apparatus 120 can comprise a single-web device that manipulates a single web to wrap products (such as by folding the web 122 into a C-fold arrangement similar to that previously discussed); alternatively, the apparatus can comprise a dual-web device that advances a second web (not shown) parallel to the web 122 with product disposed therebetween and then seals the two webs together along their edges and along transverse seal lines to form packages and severs the packages from the webs.

The label 44' having the tab portion 50' forms an easy-opening feature 40' that is operated by grasping the tab portion and pulling in the direction indicated by the arrow in FIG. 8, which causes the tear feature in the web 122 to initiate a tear in the web.

The invention also encompasses other alternative easy-opening features. FIG. 9 shows one such alternative easy-opening feature 140. A web 142 is perforated along two lines 144 that form a generally X-shaped configuration, thus forming four generally triangular tear portions in the web. A label 146 is affixed to the web over the perforation lines 144; preferably, the perforation lines do not extend all the way to the outer edges of the label. The label includes a tab portion 148. To operate the easy-opening feature 140, the tab portion 148 is grasped and pulled in the direction toward the opposite edge of the label (to the left in FIG. 9), which causes the web to begin tearing along the lines 144.

FIG. 10 shows another easy-opening feature 150 in accordance with the invention. The feature 150 is formed by an label 152 applied to an exterior surface (i.e., the side facing away from a packaged product) of a web 154. Both the label and the web are slit to form one or more tab portions 156 and corresponding tear portions 158 in the web that are adhered to the respective tab portions. In accordance with this embodiment, the label 152 includes a non-heat shrinkable layer 160 and a heat-shrinkable layer 162. The heat-shrinkable layer 162 is outward of the non-heat-shrinkable layer 160, forming the exterior surface of the label in the illustrated embodiment. When heated to cause the heat-shrinkable layer 162 to shrink, the tab portions 156 and corresponding tear portions 158 are caused to curl outwardly away from the product in the package. In this manner, the tab portions are made easier to grasp.

A similar effect can be achieved in a shrink-wrap package by the alternative easy-opening feature 150' shown in FIG. 11. In this embodiment, a non-heat-shrinkable label 152' is affixed to an interior surface (i.e., the side facing the product) of a heat-shrinkable web 154 and is then slit along with the web to form one or more tab portions 156 and corresponding tear portions 158. When the package is heated to shrink the web 154, the tear portions 158 of the web will curl outwardly and cause the attached tab portions 156 to also curl, thus making the tab portions easier to grasp.

FIG. 12 shows yet another embodiment of the invention. The easy-opening feature 170 in FIG. 12 includes an label 172 affixed to a web 174. The label and web are punched to form one or more tab portions 176 and corresponding tear portions (not visible). The label and web are punched so as to remove material of the label and web, thus forming openings 178. A finger can be inserted into the openings to aid in grasping the tab portions.

FIG. 13 depicts still another embodiment of the invention. The easy-opening feature 180 shown in FIG. 13 includes an label 182 affixed to a web 184. The label includes a middle portion 186, denoted by cross-hatching in the drawing, that is not affixed to the web; the other portions of the label on opposite sides of the middle portion are affixed to the web by adhesive or other means. The web is perforated, slit, scored, or otherwise weakened along a plurality of lines 188 located so as to be covered by the adhesive portions of the label. The lines 188 preferably radiate outwardly from the middle portion of the label. The middle portion 186 of the label is slit along a line 190 that bisects the portion so that half of the portion form a tab portion connected to one adhesive portion and the other half forms a tab portion connected to the other adhesive portion of the label. The easy-opening feature is operated by grasping one or both of the tab portions and pulling them generally away from each other to cause the web to begin tearing along the lines 188.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An easy-open flexible package, comprising:

flexible web material having two portions arranged in opposing relation and sealed together along respective edges thereof to form an enclosure for a product; and an easy-opening feature provided in the web material, the easy-opening feature comprising:

a tear feature formed in the web material to act as a stress riser at which tearing of the web material can be initiated; and a label affixed to the web material, the label having a detachable portion that is affixed to the tear feature, the label further including side portions detachably joined to opposite edges of the detachable portion, the side portions being affixed to the web material, such that the detachable portion when pulled detaches completely from the side portions and pulls the tear feature so as to tear the web material to create an opening therein, and the side portions of the label remain affixed to the web material adjacent the opening to serve as additional grasp-and-tear points.

2. The easy-open flexible package of claim 1, wherein the tear feature is formed by a slit or perforation in the web material.

3. The easy-open flexible package of claim 2, wherein the slit or perforation is generally U-shaped.

4. The easy-open flexible package of claim 1, wherein the detachable portion of the label includes a tab portion that is not affixed to the web material such that the tab portion can be readily grasped.

5. The easy-open flexible package of claim 1, wherein the detachable portion and side portions of the label collectively form a circular portion of the label that is affixed to the web material.

6. An easy-open flexible package, comprising:

flexible web material having two portions arranged in opposing relation and sealed together along respective edges thereof to form an enclosure for a product; and an easy-opening feature provided in the web material, the easy-opening feature comprising:

a tear feature formed in the web material to act as a stress riser at which tearing of the web material can be initiated; and a label affixed to the web material, the label having a pair of spaced lines of weakness extending from one edge to an opposite edge of the label, the lines of weakness defining opposite edges of a detachable portion of the label that is affixed to the tear feature, the label further including side portions detachably joined to the opposite edges of the detachable portion, the side portions being affixed to the web material, such that the detachable portion when pulled detaches completely from the side portions and pulls the tear feature so as to tear the web material to create an opening therein, and the side portions of the label remain affixed to the web material adjacent the opening to serve as additional grasp-and-tear points.

* * * * *